United States Patent [19]

Schneider et al.

[11] Patent Number: 4,505,181

[45] Date of Patent: Mar. 19, 1985

[54] STEPWISE DOUBLE-CARTRIDGE-ALTERNATE FEEDER FOR AN AUTOMATIC WEAPON HAVING A STRAIGHT BREECH OPERATION

[75] Inventors: Bernhard Schneider, Niederkruechten; Horst Menges, Ratingen, both of Fed. Rep. of Germany

[73] Assignee: Rheinmetall GmbH, Duesseldorf, Fed. Rep. of Germany

[21] Appl. No.: 479,196

[22] Filed: Mar. 28, 1983

[30] Foreign Application Priority Data

Mar. 26, 1982 [DE] Fed. Rep. of Germany ..... 3211132

[51] Int. Cl.[3] ..... F41D 10/32

[52] U.S. Cl. ..... 89/33.04; 89/33.25

[58] Field of Search ..... 89/11, 33 BA, 33 BC, 89/33 CA, 33 SF, 33.17, 33.16, 33.25, 33.04

[56] References Cited

U.S. PATENT DOCUMENTS 4,418,607 12/1983 Price ..... 89/11

*Primary Examiner*—Stephen C. Bentley

[57] ABSTRACT

A double-cartridge feeder has left and right sprocket wheel transport shafts. Each transport shaft is provided with a star wheel coaxially mounted thereon. A reciprocally movable switching fork is arranged on a first alternate drive. A second alternate drive serves for swinging of an inserter into an operative position in dependence with the sprocket wheel transport shaft which has been selectively driven via the first alternate drive. By means of a globoidal drive a uniform movement of an external drive is converted into a step-wise movement of the feeder.

6 Claims, 3 Drawing Figures

STEPWISE DOUBLE-CARTRIDGE-ALTERNATE FEEDER FOR AN AUTOMATIC WEAPON HAVING A STRAIGHT BREECH OPERATION

BACKGROUND OF THE INVENTION

The invention relates to a cartridge feeder of the type described in U.S. Pat. No. 4,223,589 coassigned to the assignee of this application. In this known arrangement a left and right sprocket wheel support shaft are hollow and have mounted in their interiors coaxially arranged switching shafts with holding and transport couplings. The energy for their stepwise movement can be obtained from the energy released during firing and transmitted via the transport coupling. An alternate drive forms part of the arrangement and includes a slidable gear rack movable transversely with respect to the longitudinal axis of the weapon and a switching member which is rotatable about the longitudinal axis of the weapon. Both of these members are positively connected to each other so that, by way of rotational movement of the switching member, the transverse movement of the gear rack results. By means of the movement of the gear rack certain elements for positioning corresponding cartridges into the inserted position are transversely pivoted. Simultaneously there results a counter-directional axial movement of the switching shaft for the coupling and uncoupling by the action of the switching member. The holding couplings serve thereby for receiving tensional forces counter to the feed direction. Large masses must be moved along the partially extended switching path in the rotational, transverse and longitudinal direction.

SUMMARY OF THE INVENTION

It is an object of this invention to provide an automatic ammunition feeder of the afore-described type, which feeder operates with relatively small masses which operatively move along relatively short switching paths, preferably in an axial direction.

BRIEF DESCRIPTION OF THE DRAWING

With these and other objects in view, which will become apparent in the following detailed description, the present invention, which is shown by example only, will be clearly understood in connection with the accompanying drawing, in which.

DETAILED DESCRIPTION

Figures 1, 2:
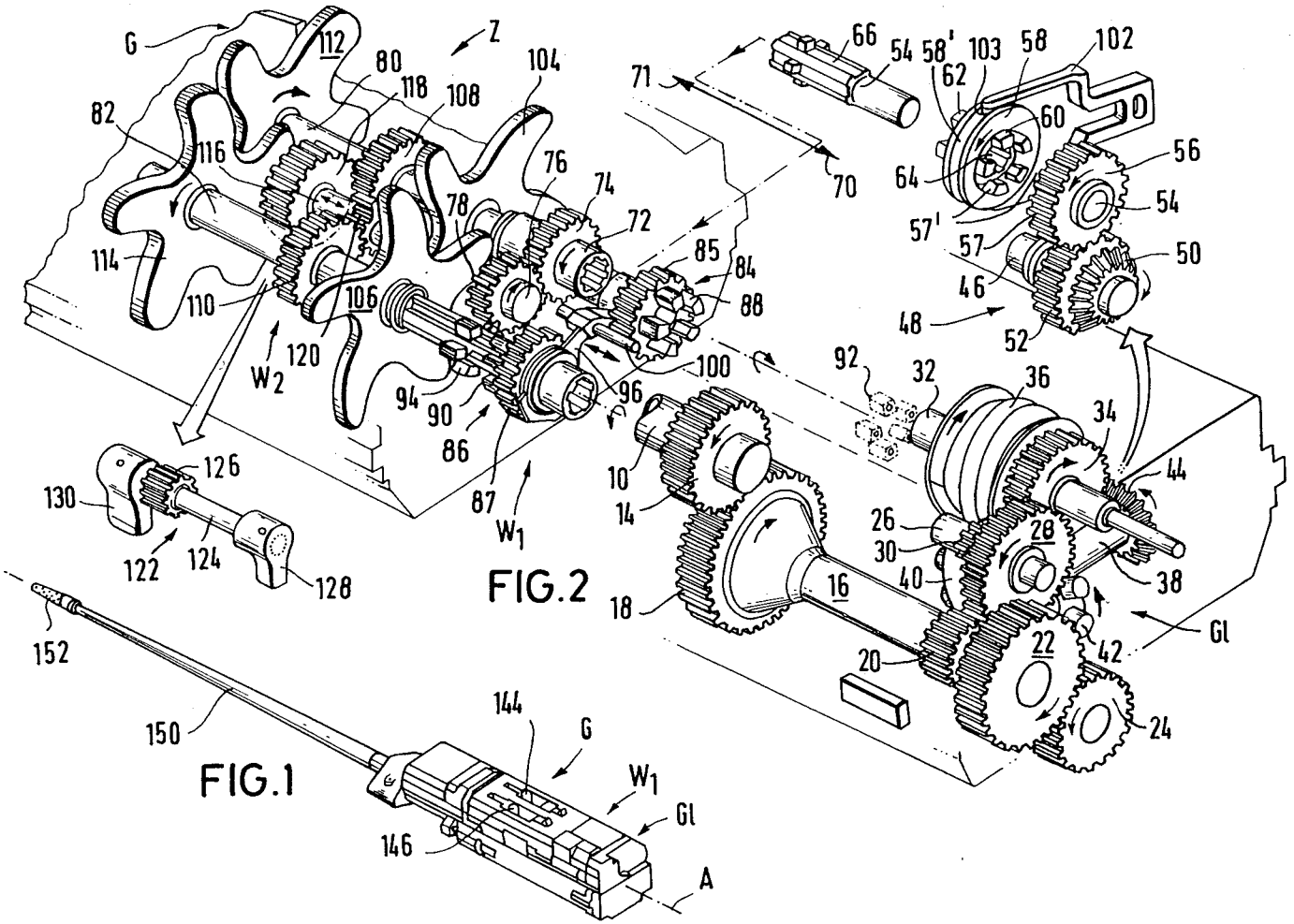
FIG. 1 illustrates a machine cannon having an exterior drive, which is equipped with an ammunition feeder in accordance with this invention, which machine cannon is shown in perspective, the cradle and gun carriage have been omitted for sake of clarity.
FIG. 2 is an explosive view in perspective of a double-cartridge feeder in accordance with the invention in which the various parts are illustrated in an enlarged scale.
Figure 3:
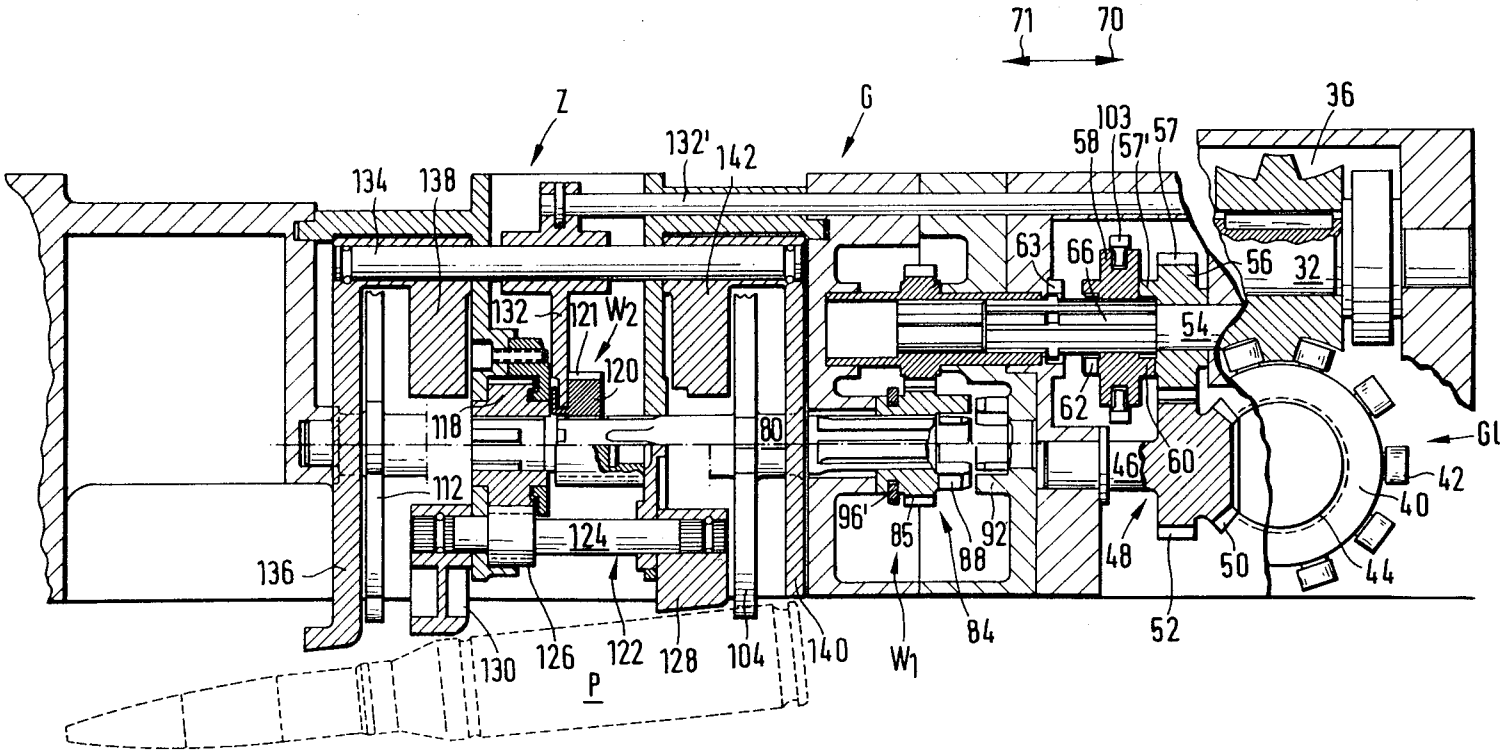
FIG. 3 is a longitudinal cross-sectional view to the double-cartridge-feeder along a plane parallel to the longitudinal axis of the weapon.

There is illustrated in FIG. 1 a housing G in which a machine cannon having an external drive is mounted. This machine cannon includes a gun barrel 150 and a muzzle brake 152 as well as a step-controlled double-cartridge-feeder Z, an alternate drive $W_1$ and a globoidal drive G1. A shaft 10, only a part of which is illustrated in FIG. 2, is positively connected to a non-illustrated hydraulic motor and fixedly supports a gear wheel 14. The latter gear wheel meshes with a gear wheel 18 fixedly mounted at one end of a shaft 16 at the other end of which there are mounted gear wheels 20 and 22. The gear wheel 20 meshes with a gear wheel 28 fixedly mounted on a shaft 26 adjacent to which there is mounted a gear wheel 30. The latter gear wheel meshes with a gear wheel 34 fixedly mounted on a shaft 32 for continuously rotating a globoidal worm gear 36. The gear wheel 22 meshes with a gear wheel 24 for purposes of being positively connected to a non-illustrated breech control mechanism, the detailed description of which mechanism can, in the context of this invention, be omitted from the specification. All of the afore-described shafts are parallel to the longitudinal axis A of the weapon. A shaft 38, however, extends transversely to the longitudinal axis A of the weapon. At one end of the shaft 38 there is fixedly mounted a support disc 40 on which there are equi-distantly spaced along its periphery at angular distances of 36 degrees ten rollers 42 mounted thereon for coacting with the globoidal worm gear 36. As a result of the coaction of the continuous rotary movement in the clockwise sense of the driven globoidal worm gear 36 and the support disc 40 there results a stepwise rotational movement of the shaft 38. At the end of the shaft 38 which is opposite to that on which the support disc 40 is mounted there is mounted a conical gear wheel 44 for making a positive connection with a double gear wheel 48. The conical gear wheel 44 meshes with a conical gear ring 50 of the double gear wheel 48, whereas a peripheral gear ring 52 meshes with the gear ring 57 of a gear 56, fixedly mounted on a shaft 54 which is parallel to the shaft 46. Shaft 54 confronts with its left end face a claw-coupling 57' (FIG. 3). A coupling member 58 has on the end faces which confront each other coupling claws 60 and 62 and has on its interior side a plurality of splines 64. These splines 64 mate with splines 66 on the shaft 54. By means of a switching fork 102, which with its ends 103 engages in a peripheral groove 58', the coupling 58 is moved in the direction of an arrow 70 for positively engaging with the claw-coupling 57' of the gear wheel 56 into engagement with which it is pushed and is moved into the direction of an arrow 71 out of this positive engagement and is again pushed inwardly by means of the coupling claws 62 into positive engagement with coupling claws 63 rigidly connected to the housing G. The splined end 66 of the shaft 54 engages in an interiorly formed splined groove of the hollow shaft 72, which shaft supports a gear wheel 74. A shaft 76 supporting a gear wheel 78 extends parallelly to the hollow shaft 72. The gear wheel 74 meshes with the gear wheel 78. The gear wheel 74 drives the right sprocket wheel transport shaft 80, whereas the gear wheel 78 coacts with the left sprocket wheel transport shaft 82 in a manner to be described hereinbelow. A switching hub 84 is slidably mounted on the right sprocket wheel transport shaft 80 and a switching hub 86 is axially slidably mounted on the left sprocket wheel transport shaft 82. The switching hub 84 can be positively connected to the gear wheel 74 via a gear wheel ring 85 and the switching hub 86 can be positively connected to the gear wheel 78 via a gear wheel ring 87. The switching hub 84 is provided at its rear end face with coupling claws 88, whereas the switching hub 86 is provided at its front end face with coupling claws 90. Both switching hubs 84 and 86 are mutually offset in the direction of the longitudinal axis A and are connected to each other for axial movement (see double arrow in FIG. 2) via a switching fork 96 which positively engages with corresponding free ends 96' via recesses not illustrated in detail into the corresponding switching hubs. The switching fork 96 can be actuated by way of a rod 100 only a portion of which has been illustrated for sake of clarity. Due to the axial offsetting arrangement of both switching hubs 84 and 86 there results a positive connection at axial movement in the direction of the arrow 70 between the coupling claws 88 and the coupling claws 92 which are firmly connected to or integral with the housing G, whereas the peripheral ring gear 87 of the switching hub 86 meshes with the gear wheel 78. In this fashion the left sprocket wheel transport shaft 82 is switched into a position in which it can be driven, whereas the right sprocket wheel transport shaft 80 is positively blocked in the housing G. By axially slidably moving the hub 84 blocks in the direction of the arrow 71 the blocking positive connection between the coupling claws 92 and 88, which blocks the rotation of the right sprocket wheel transport shaft 80, is removed and the peripheral gear ring 85 of the switching hub 84 can now mesh with the gear wheel 74, whereas after removing the positive connection between the peripheral gear ring 87 of the switching hub 86 with the gear wheel 78 the coupling claws 90 of the switching hub 86 reach a blocking positive connection with the coupling claws 94 which are affixed to the housing. In the last described position the right sprocket wheel transport shaft 80 is now drivable. The sprocket wheel transport shaft 80 has a rearwardly disposed star wheel 104 and a forwardly disposed star wheel 112. A gear wheel 108 is fixedly mounted between the forward and rear star wheels 104, and 112 on the star wheel transport shaft 80. The star wheel transport shaft 82 has mounted thereon a rear star wheel 106 and a forward star wheel 114, between which a gear wheel 110 is fixedly mounted on the sprocket wheel transport shaft 82. The gear wheels 108 and 110 are also adapted to be axially mutually offset. An axially slidable switching hub 120 together with a shaft 116, parallel to the shafts 80, 82, on which a gear wheel 118 is mounted, is arranged between both sprocket wheel transport shafts 80 and 82. The switching hub 120 with its peripheral ring gear 121 is adapted to come into meshing engagement by means of a switching fork 132 either with the gear wheel 108 or the gear wheel 110. The switching fork 132 can be actuated by means of a rod 132'. The switching forks 132 and 96 for synchronous axial movements are connected to each other in a non-illustrated manner. As has been mentioned hereinabove, the axial movement of the switching fork 96 in the direction of the arrow 71 makes possible a positive connection of the right sprocket wheel transport shaft 80 with the gear drive which initiates at shaft 10. Synchronously with the axial movement of the switching fork 96 the switching hub 120 reaches a meshing engagement with the gear wheel 108 mounted on the sprocket wheel transport shaft 80, so that the gear wheel 108 rotates in a counter direction to the rotation of the sprocket wheel transport shaft 80. An analogous operation occurs at the switching movement in the direction of the arrow 70, whereby the left sprocket wheel transport shaft 82 and the gear wheel 118 are drivable in opposite directions. In the housing G there is mounted below the shaft 116 a shaft 124 on which a gear wheel 126 is mounted. At the end of the shaft 124 which confronts the rear star wheels there is mounted an element 128 and at the other forward end which confronts the forward star wheels an element 130 is mounted. Both elements 128 and 130 are fixed on the shaft 124. Via the exterior contours not illustrated in detail of both elements 128 and 130 there is determined an inclined plane relative to the longitudinal axis A. The elements 128 and 130 form part of an inserting arrangement 122, which can be pivoted in dependency of whether it is to be switched to one or the other star wheel transport shaft in the clockwise or counterclockwise direction. Whereas the last described elements form part of an alternate drive $W_2$, the previously described switching hubs 84 and 86 form part of an alternate drive $W_1$. The guide elements 136 and 140 are pivotable against return spring forces of non-illustrated springs which are mounted on a shaft 134 parallel to the longitudinal axis A and is disposed on a non-illustrated middle plane of the housing G, whereas the regions 138, respectively 142 connected therewith, serve for contacting the previously mentioned return springs. An ammunition belt channel 144 is arranged in the housing G for the right sprocket wheel transport shaft 80 and an ammunition belt channel 146 is arranged in the housing G for the left sprocket wheel transport shaft 82. Each one of the ammunition belt channels includes in its interior the well-known and therefore not illustrated debelting means.

There is hung on both sprocket wheel transport shafts 80 and 82 in a known manner a non-illustrated ammunition belt. The transport coupling 58 is positively connected via the coupling halves 60 and 57' and the gear wheel 56 with the gear drive. The right sprocket wheel transport shaft 80 is selected via the alternate drive $W_1$ and the gear wheel 120 is placed into meshing engagement with the gear wheel 108 via the alternate drive $W_2$. In a non-illustrated manner there is disposed on each side of the feeder Z a debelted cartridge in a so-called standby position. By activating the arrangement the right sprocket wheel transport shaft 80 is stepwise driven via the globoidal drive G1. Each driven step (in dependence with the arrangement of the rollers 42) corresponds to a rotational movement of 36 degrees, whereby two driven steps corresponds to a transport step. As a result of the first driven step the corresponding cartridge is moved from its standby position into a transfer position, in which it is already situated in the effective region operative of the inserter 122. A fivefold translation is carried out via the gear wheels 118 and 126 relative to the rotational movement of the sprocket wheel transport shaft 80, so that the inserter 122 moves the seized cartridge P with high velocity into the inclined insertion position illustrated in FIG. 3. A non-illustrated straight breech block seizes during its movements in the direction towards the gun barrel 150 the cartridge in the region of its bottom, which has not been illustrated in detail, and guides this cartridge into the loading chamber of the gun barrel 150 for purposes of having it fired therefrom. For changing from the right sprocket wheel transport shaft 80 to the left sprocket wheel transport shaft 82 it is only necessary to actuate both alternate drive $W_1$ and $W_2$ by means of a switching movement in the direction of the arrow 70. In view of the fact that the non-operating sprocket wheel transport shaft is positively blocked via the corresponding coupling claws fixed to the housing, there is taken up via the corresponding positive connection a tensional force emanating from the belt. In order to deactivate the weapon the switching fork 102 is operatively uncoupled by means of a non-illustrated hydraulic mechanism for purposes of initiating a braking cycle of the transport coupling 58 via the axial sliding of the switching fork 102 which breaking cycle has not been described in detail, and for receiving the ammunition belt pull from the sprocket wheel transport shaft which has operated prior to the firing interruption there is caused an arresting via the coupling claws 62 and 92 in the housing G.

As can be observed from the afore-described operation there are required for changing from one side to the other side of the feeder Z and conversely advantageously only short switching paths which extends along the longitudinal axis A. Moreover, only small masses are required to be moved and therefore high changing speeds are achievable. Moreover, actuation of the transport coupling 58 as well as the actuation of the switching drives $W_1$ and $W_2$ are effected by hydraulic means which, in the context of this invention, do not require a detailed description. The elements 136, 138 and 140, 142, which are springingly mounted, serve advantageously for both sprocket wheel transport shafts 80 and 82 as stops for the corresponding cartridge P after it has left its standby position for purposes of transferring it to the inserter 122 at which the cartridge P has already been removed from the effective region of the star wheels. In their middle position the elements 136 and 140 form with not further illustrated contours of their free ends a guide for the cartridge P as it is moved by the entrainer for insertion into the gun barrel 150.

Although the invention is described and illustrated with reference to a single preferred embodiment thereof, it is to be expressly understood that it is in no way limited to the disclosure of such preferred embodiment but is capable of numerous modifications within the scope of the appended claims.

We claim:

1. In an improved step-wise actuated double-cartridge feeder for an automatic weapon, in particular a machine cannon having a linearly operating breech block and a left and right sprocket wheel transport shaft operatively mounted in said feeder symmetrically with respect to the longitudinal axis of the weapon, wherein each transport shaft coacts with corresponding holding coupling means and each is operatively mounted in a housing which includes left and right feed channels, said transport shafts being selectively drivable in mutually opposite directions, alternate driving means operatively mounted in said housing for axially slidably displacing said holding coupling means, a control element is transversely pivotally mounted relative to the longitudinal axis of the weapon between said transport shafts and is adapted to position a cartridge transported by a driven sprocket wheel transport shaft in a predetermined manner into operative coaction with the linearly operating breech block for the purpose of being transported into the loading chamber in the gun barrel of the automatic weapon, the improvement comprising (a) means for stepwise driving a preselected one of said left and right transport shafts which include a globoidal worm gear;

(b) an external drive having an actuating element adapted to be uniformly driven thereby, said actuating element being positively connected to said globoidal worm gear;

(c) said globoidal worm gear being adapted to directly drive a first shaft operatively mounted in said feeder, said first shaft coaxially supporting a first gear wheel;

(d) a second shaft is operatively mounted in said feeder parallel to said first shaft, said second shaft coaxially supporting a second gear wheel which meshes with said first gear wheel, said first shaft being adapted to drivingly coact with said right transport shaft and said second shaft being adapted to drivingly coact with said left transport shaft;

(e) first alternate driving means being longitudinally slidably mounted in said feeder parallelly to the longitudinal axis of said weapon, said first alternate driving means including a switching fork which is adapted to selectively couple said first alternate driving means to said globoidal worm gear;

(f) each holding coupling means coacting with the corresponding transport shaft comprises a first coupling half and a second coupling half which is fixed to the housing, whereby when both halves are positively coupled any rotation of the corresponding transport shaft is prevented;

(g) a switching hub operatively coacting with a coupling half of each coupling means;

(h) each switching hub includes form locking means adapted to coact with a corresponding transport shaft and is axially slidably displaceable relative thereto; each switching hub including a gear ring which is adapted to respectively mesh with said first and second gear wheel and a first switching fork operatively connected to both switching hubs;

(i) said first switching fork being adapted to be selectively moved to a first position in which said gear rings are respectively moved into meshing and driving engagement with said first and second gear wheels and said first coupling half is moved out of engagement with said second coupling half and to a second position in which said gear rings are respectively moved out of meshing and driving engagement with said first and second gear wheels and said first coupling half engages said second coupling half; and (j) including cartridge inserting means operatively mounted in said feeder and adapted to selectively coact with said left and right transport shafts and forming part of a second alternate driving means of said feeder, whereby said second alternate driving means is adapted to selectively drivingly couple said cartridge inserting means to said left or said right transport shaft.

2. The improvement in a double cartridge feeder as set forth in claim 1, wherein (a) said switching hubs are synchronously slidably displaceable;

(b) said second coupling halves being integral with said housing;

(c) said cartridge inserting means includes a third rotatably mounted shaft mounted in said feeder below said right and left transport shafts;

(d) a third gear wheel coaxially secured on said third shaft;

(e) said third gear wheel meshes with a fourth gear wheel mounted on a fourth shaft which is rotatably mounted in said feeder between said left and right transport shafts;

(f) one of said switching hubs is coaxially slidably displaceable on said fourth shaft for form-locking engagement in opposite directions;

(g) said gear ring is coaxially mounted on said switching hub; and (h) a fifth and sixth gear wheel is respectively coaxially secured to said left and right transport shaft, said gear ring selectively drivingly meshes with said fifth and sixth gear wheel.

3. The improvement in a double cartridge feeder as set forth in claim 2, wherein (a) said cartridge inserting means includes a second switching fork; and (b) said second switching fork coacts with a third switching hub rotatably mounted in said feeder between said fifth and sixth gear wheel.

4. The improvement in a double cartridge feeder as set forth in claim 3, wherein said first and second switching forks are operatively connected so as to move synchronously.

5. The improvement in a double cartridge feeder as set forth in claim 4, wherein said cartridge inserting means is adapted to seize a cartridge within a preselected feed channel and move said seized cartridge into a fire-ready position.

6. The improvement in a double cartridge feeder as set forth in claim 5, wherein said second alternate driving means includes a reduction gear which is operatively connected to said cartridge inserting means so as to increase in a predetermined manner the angular velocity of the pivotal movement of said cartridge inserting means relative to the angular velocity of the corresponding driven transport shaft.

* * * * *